US007422489B1

(12) United States Patent
Tseng

(10) Patent No.: US 7,422,489 B1
(45) Date of Patent: Sep. 9, 2008

(54) DECORATIVE LIGHT

(76) Inventor: Wei-Jen Tseng, 5F, No. 10, Lane 23, Tungshan St., Hsinchu City (TW)

( * ) Notice: Subject to any disclaimer, the term of this patent is extended or adjusted under 35 U.S.C. 154(b) by 27 days.

(21) Appl. No.: 11/789,308

(22) Filed: Apr. 24, 2007

(51) Int. Cl.
*H01R 24/00* (2006.01)

(52) U.S. Cl. ..... 439/699.2; 362/654

(58) Field of Classification Search ..... 439/619, 439/699.1, 699.2; 362/654
See application file for complete search history.

(56) References Cited

U.S. PATENT DOCUMENTS 6,123,433 A * 9/2000 Chen ..... 362/654

* cited by examiner

*Primary Examiner*—Tho D Ta
(74) *Attorney, Agent, or Firm*—Jackson Walker, LLP

(57) ABSTRACT

A decorative light has a hollow base, a hollow socket, a light emitting diode (LED), two connectors and two wires. The base has a cavity, a distal end with an opening and a proximal end with a through hole. The socket is mounted in the cavity in the base through the opening and has a closed bottom with two LED lead holes. The LED is mounted in the socket and has two leads extending through the LED lead holes of the socket, and each lead having a latch hook protruding from the lead, passing through the LED lead hole and abutting the closed bottom of the socket around the LED lead hole. The connectors make electrical contact respectively with the leads. The wires connect electrically respectively to the connectors. The decorative light is convenient to assemble and reduces production cost.

17 Claims, 14 Drawing Sheets

DECORATIVE LIGHT

BACKGROUND OF THE INVENTION

1. Field of Invention The present invention relates to a decorative light, and more particularly to a decorative light that is assembled easily and reduces production cost.

2. Description of the Related Art

A decorative light has a light source, and the traditional light source is a light bulb. However, light bulbs do not convert electricity to particularly efficiently. In fact, most of the electricity is converted to heat, so the light bulb wastes electricity. Consequently, light emitting diodes (LED) recently have made significant inroads in replacing the light bulb in many applications as the preferred light source.

A conventional decorative light disclosed in U.S. Pat. No. 6,452,317 has a base, a socket, an LED and two wires. The base is hollow and has a hole. The socket is mounted in the hole of the base and has an outer surface and two LED lead holes. The LED has two leads. The leads are mounted respectively through the LED lead holes in the socket, and each lead has an end. The end of the lead must be bent to abut the outer surface of the socket, so the LED will be securely mounted in the socket. The wires extend respectively into the holes in the base, and each wire has an end and a connector. The connector is mounted on the end extending into the hole of the base and connects to the lead of the LED.

However, when the conventional decorative light is assembled, the end of the lead of the LED has to be bent. Bending the LED leads is tedious and results in an increase in production cost.

To overcome the shortcomings, the present invention provides a decorative light to mitigate or obviate the aforementioned.

SUMMARY OF THE INVENTION

The primary objective of the present invention is to provide a decorative light that is assembled easily and reduces production cost.

To achieve the objective, the decorative light in accordance with the present invention has a hollow base, a hollow socket, a light emitting diode (LED), two connectors and two wires. The connectors make electrical contact respectively with the leads. The wires connect electrically respectively to the connectors. The decorative light is convenient to assemble reduces production cost.

The base has a cavity, a distal end with an opening and a proximal end with a through hole. The socket is mounted in the cavity in the base through the opening and has a closed bottom. The closed bottom has two LED lead holes. The LED is mounted in the socket and has two leads extending respectively through the LED lead holes of the socket, and each lead has a latch hook protruding from the lead, passing through the LED lead hole and abutting the closed bottom of the socket around the LED lead hole. Each wire is mounted in the base and has a copper wire and a connector. The connectors make electrical contact respectively with the leads. The wires connect electrically respectively to the connectors. The decorative light is convenient to assemble reduces production cost.

Other objectives, advantages and novel features of the invention will become more apparent from the following detailed description when taken in conjunction with the accompanying drawings.

DETAILED DESCRIPTION OF THE INVENTION

Figure 1:
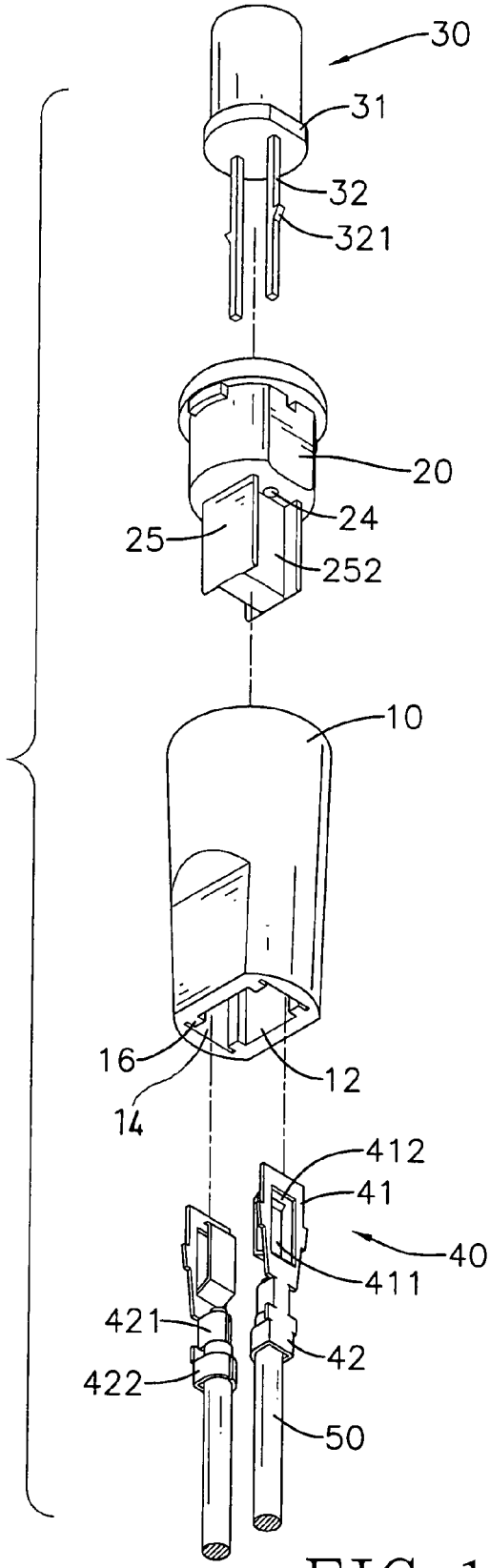
FIG. 1 is an exploded perspective view of a first embodiment of a decorative light in accordance with the present invention with a first embodiment of a connector in accordance with the present invention.
Figure 2:
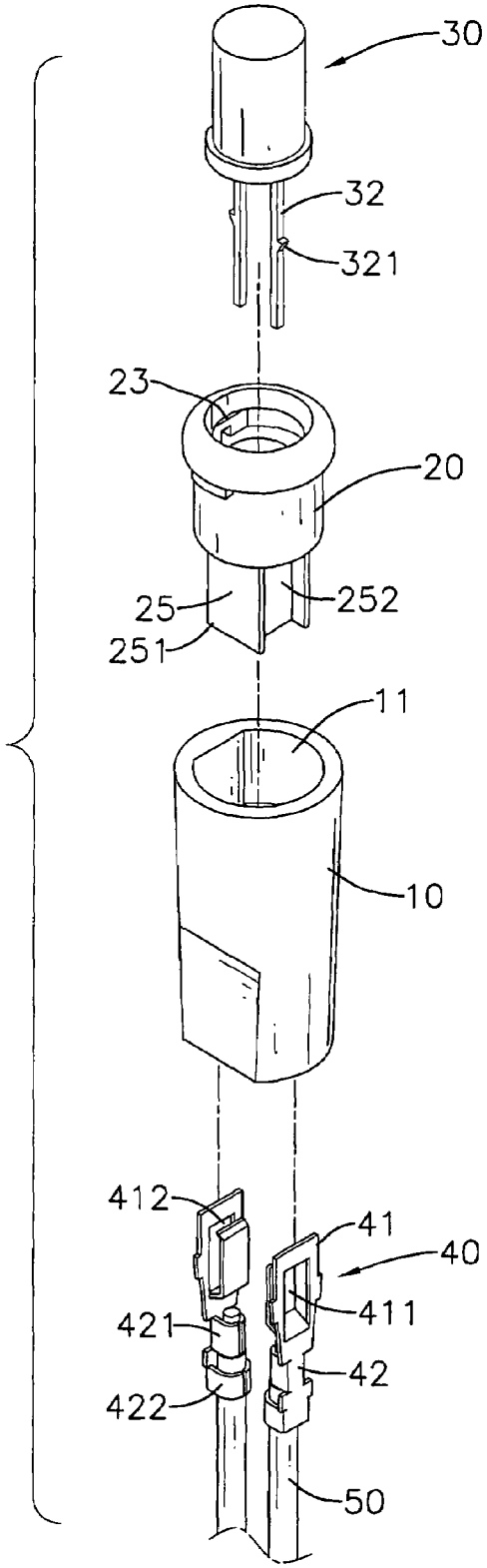
FIG. 2 is an exploded perspective view of the decorative light in FIG. 1 from above the light.

With reference to FIGS. 1, 2, 4 to 10 and 13 a decorative light in accordance with the present invention has a base (10, 10*a*), a socket (20, 20*a*), a light emitting diode (LED) (30), two connectors (40, 40*a*~40*f*) and two wires (50) and may have a globe (60).

The base (10, 10*a*) is hollow and has a cavity, a proximal end, a distal end, an inner wall and a sidewall and may have a cap (70). The distal end has an opening (11). The opening (11) is defined through the distal end, communicates with the cavity and may have a noncircular and nonsymmetrical shape. The proximal end has a through hole (12, 12*a*). The through hole (12, 12*a*) is defined through the proximal end and communicates with the cavity. The inner wall is adjacent to the through hole (12, 12*a*) at the proximal end and may have two tracks (14). The tracks (14) are formed opposite to each other and communicate with the through hole (12) at the proximal end of the base (10), and each track (14) has two sides and two rails (16). The rails (16) are formed on and protrude from the inner wall toward each other. The sidewall adjacent to the proximal end may have two recesses (15*a*). The recesses (15*a*) are formed in the sidewall opposite to each other and communicate with the cavity and the through hole (12*a*) in the proximal end of the base (10*a*). The cap (70) is mounted in and closes the through hole (12*a*).

Figure 3:
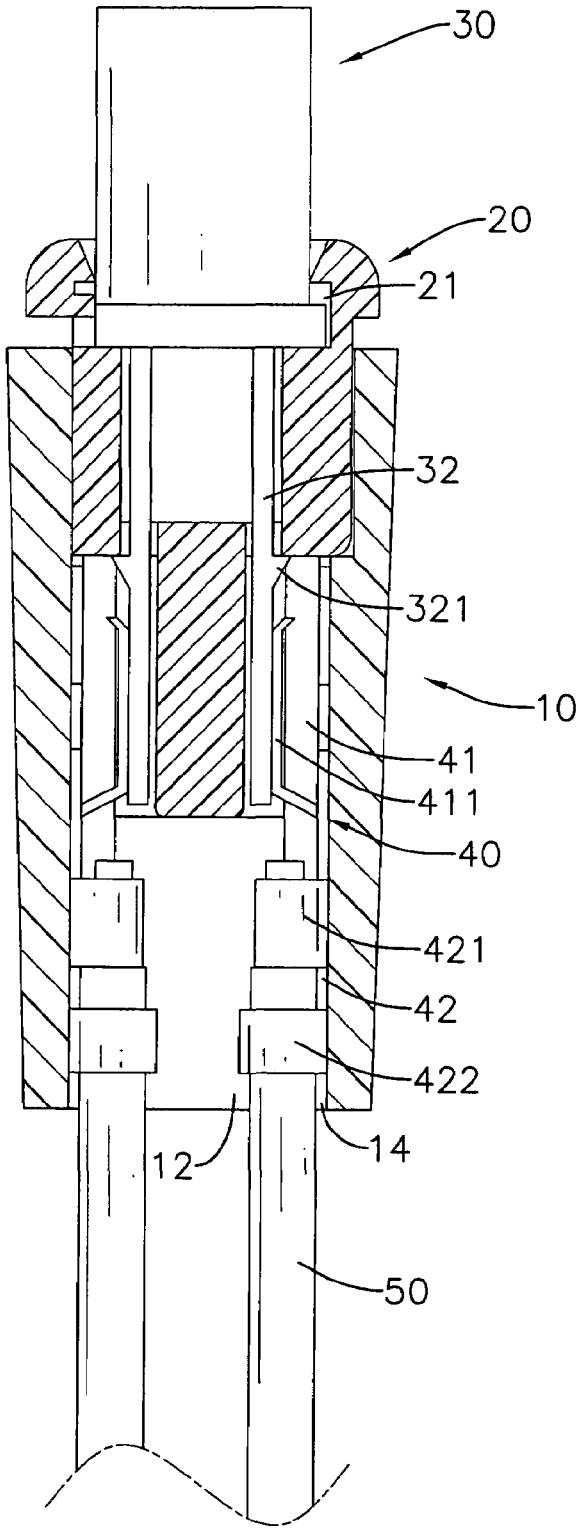
FIG. 3 is an enlarged cross sectional side view in partial section of the decorative light in FIG. 1.
Figure 4:
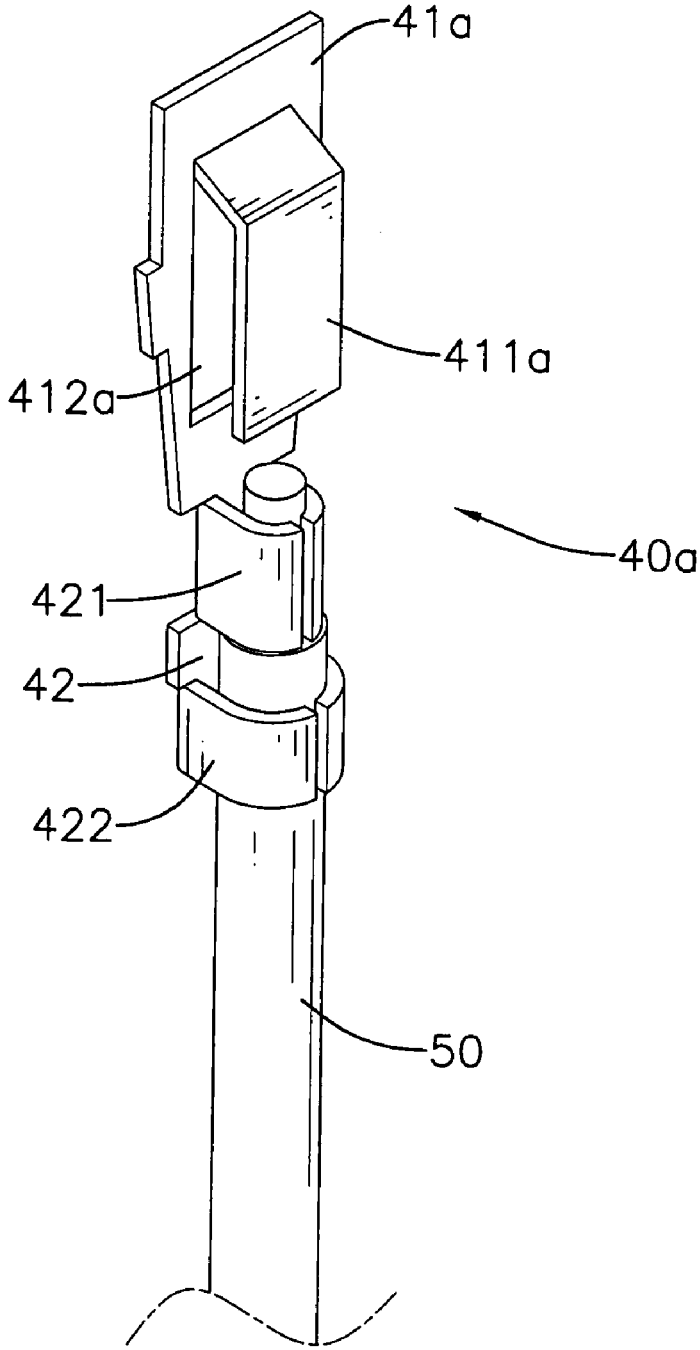
FIG. 4 is a perspective view of a second embodiment of a connector in accordance with the present invention on a wire.
Figure 5:
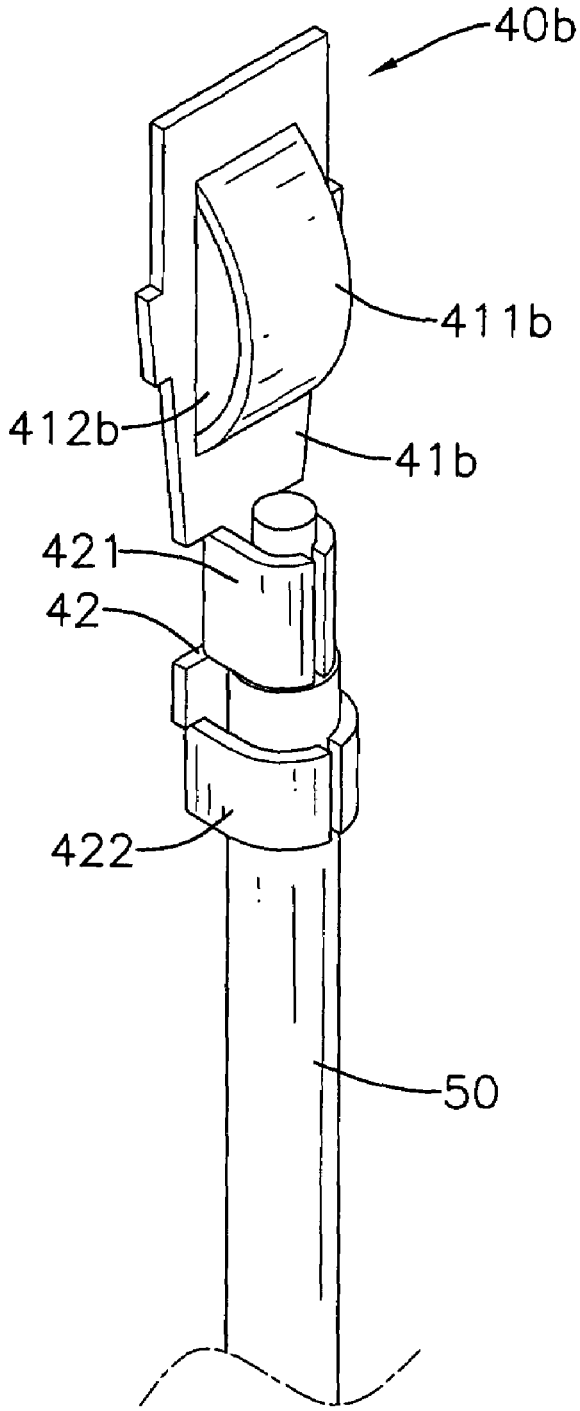
FIG. 5 is a perspective view of a third embodiment of a connector in accordance with the present invention on a wire.
Figure 6:
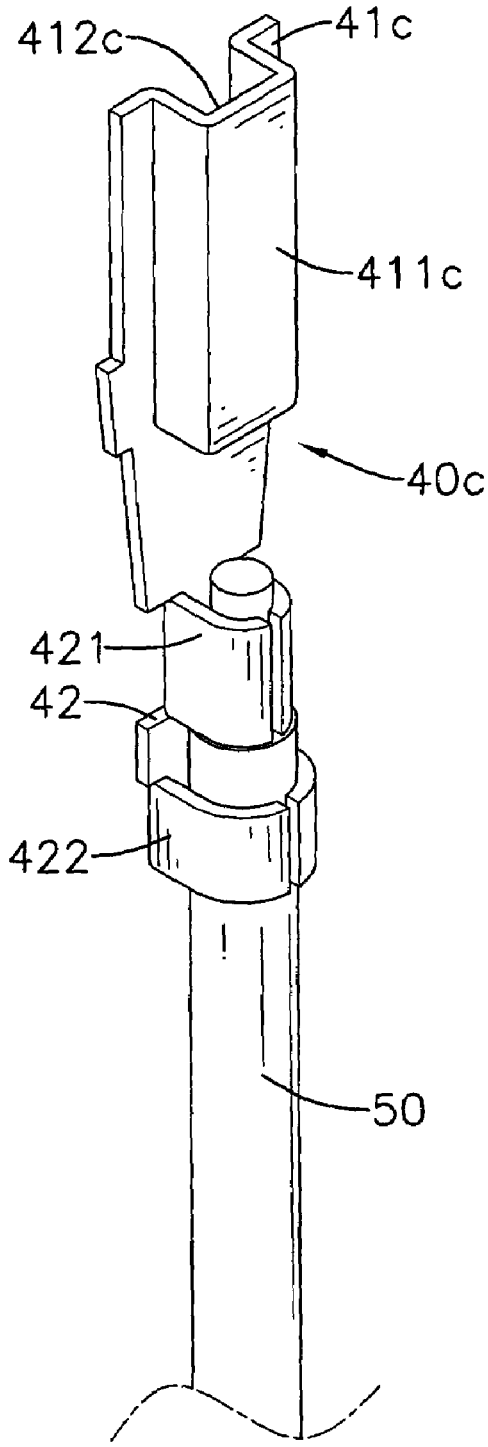
FIG. 6 is a perspective view of a fourth embodiment of a connector in accordance with the present invention on a wire.
Figure 7:
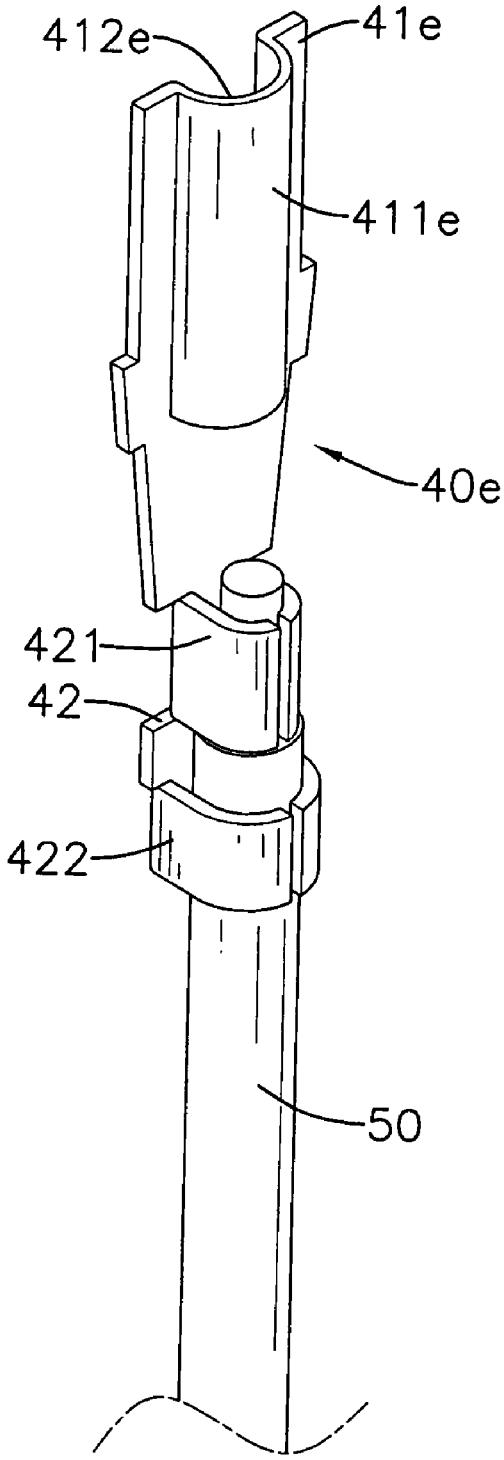
FIG. 7 is a perspective view of a fifth embodiment of a connector in accordance with the present invention on a wire.
Figure 8:
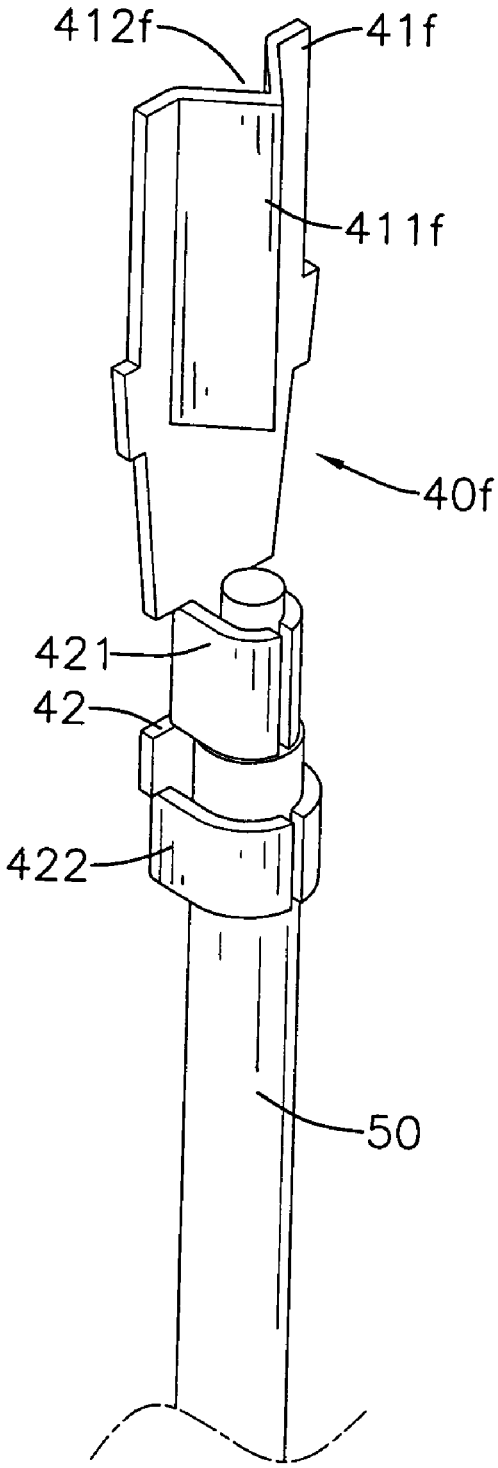
FIG. 8 is a perspective view of a sixth embodiment of a coimector in accordance with the present invention on a wire.
Figure 9:
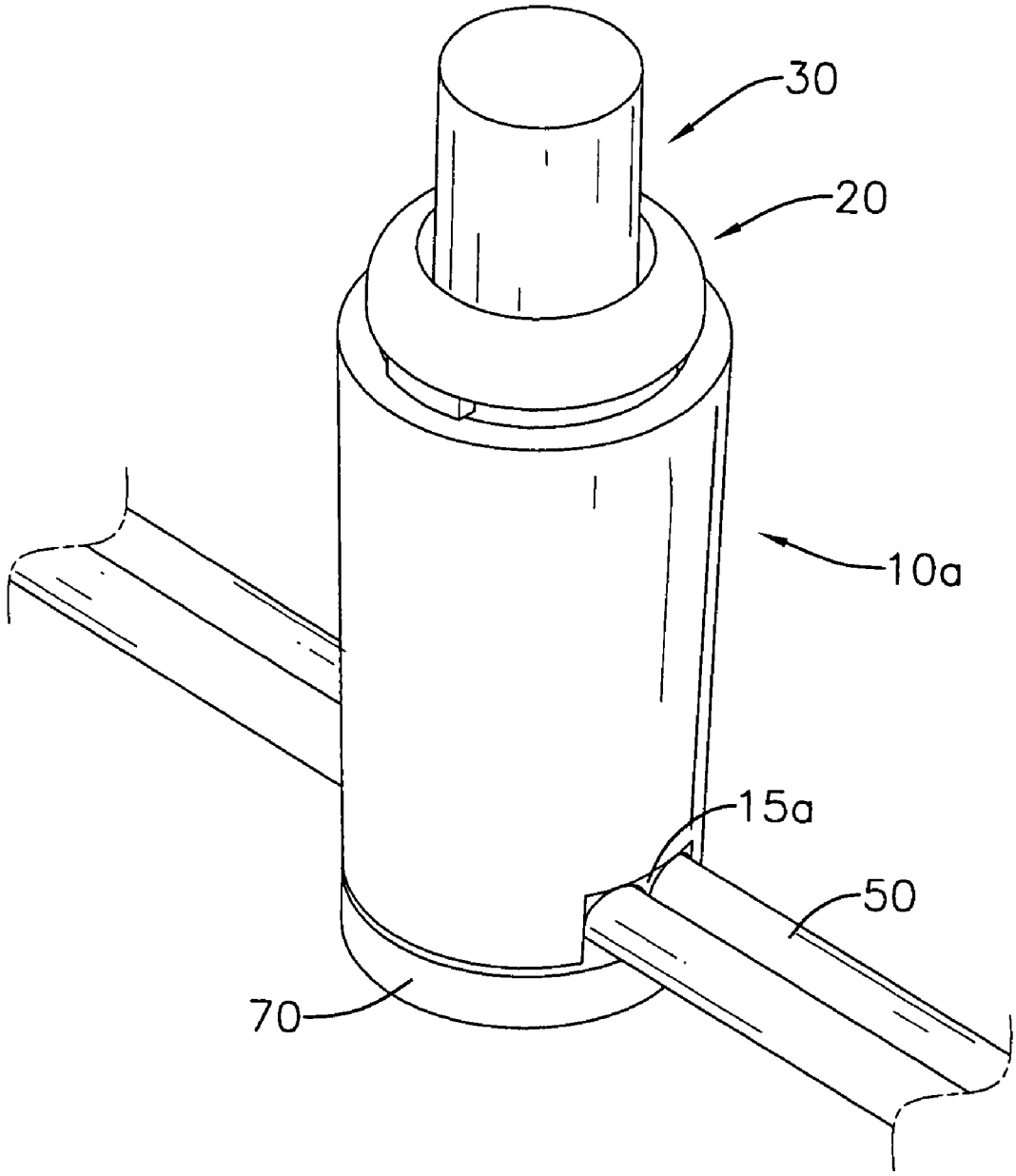
FIG. 9 is a perspective view of a second embodiment of a decorative light in accordance with the present invention.
Figure 10:
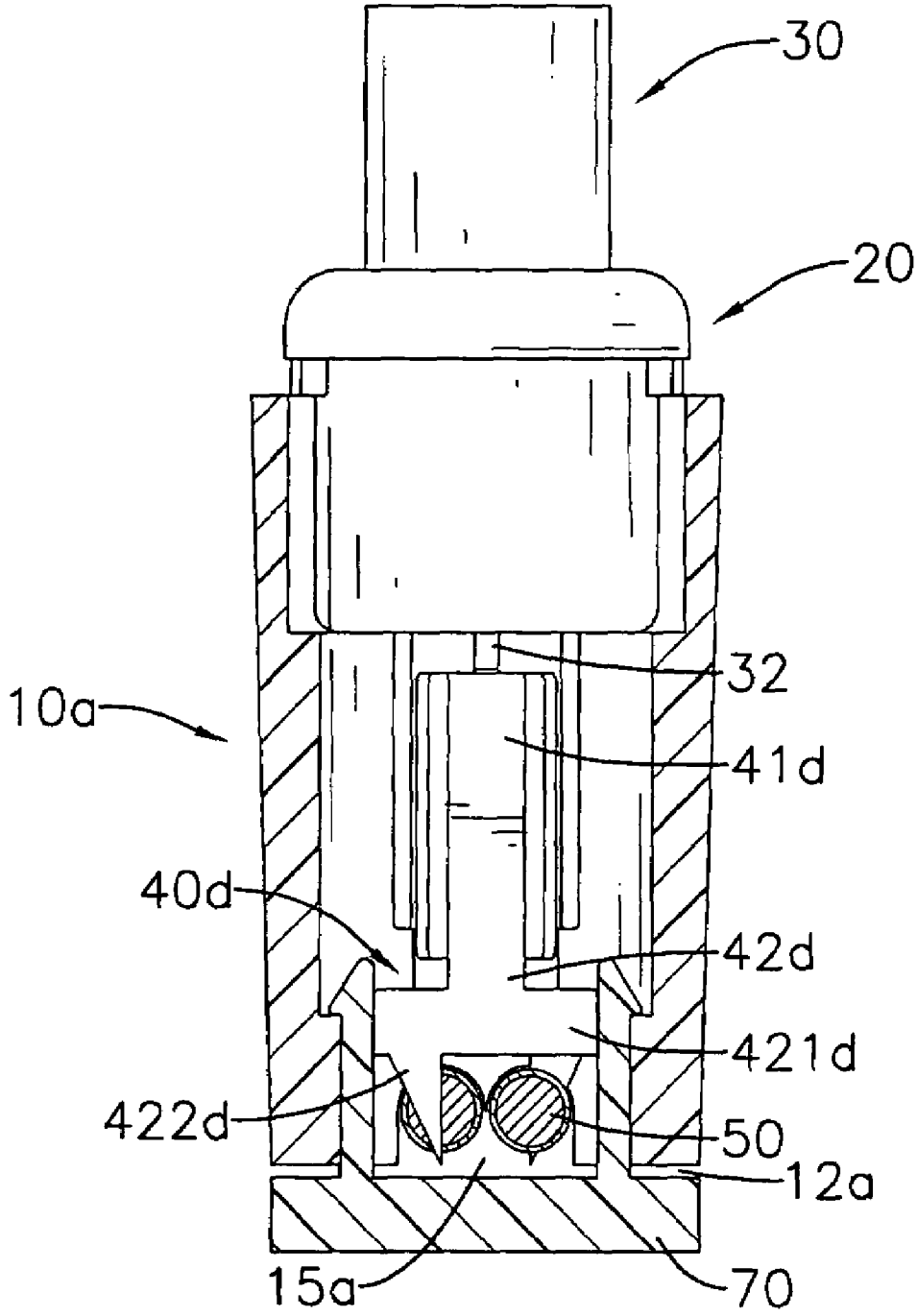
FIG. 10 is a view in partial section of the decorative light in FIG. 9.
Figure 14:
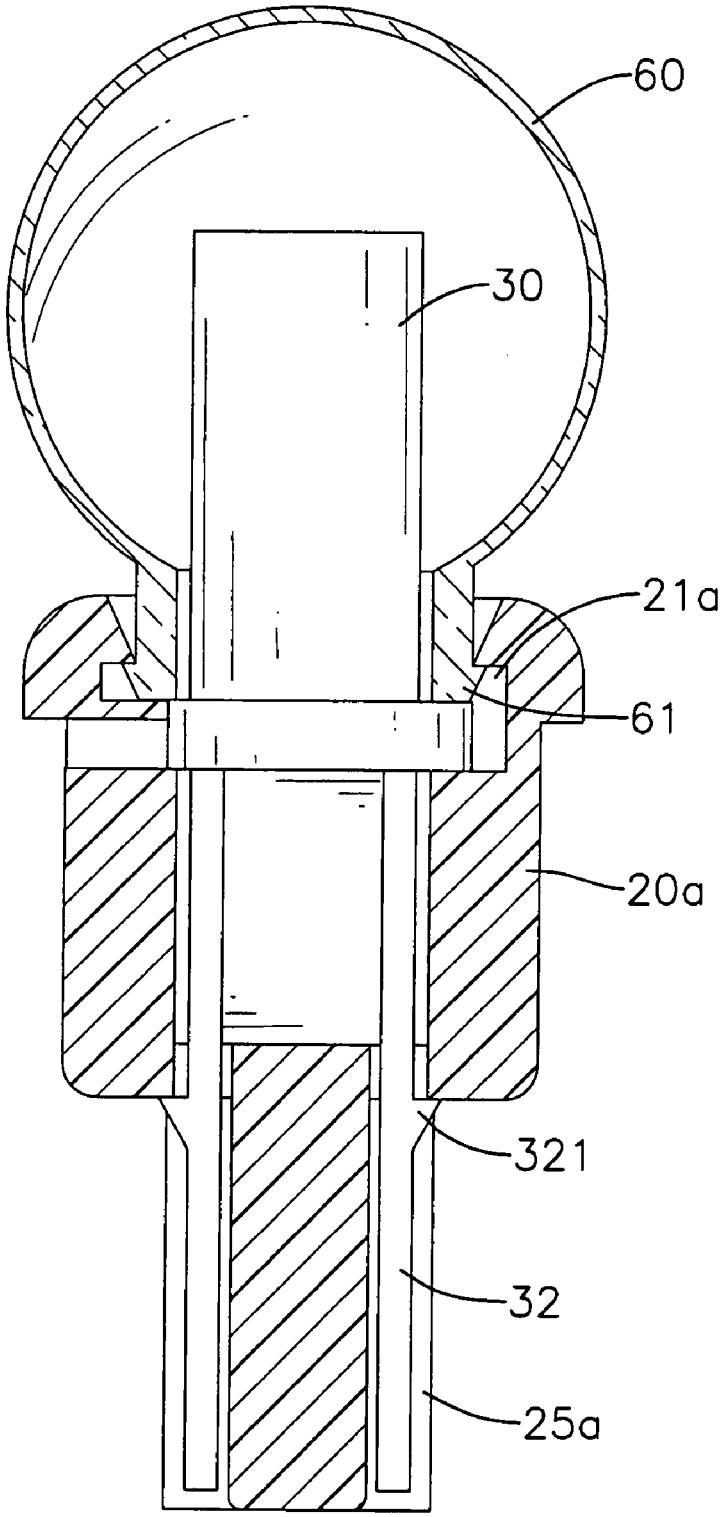
FIG. 14 is a side view in partial section of the decorative light in FIG. 13.

With further reference to FIGS. 3 and 14, the socket (20, 20*a*) is hollow, may be noncircular and nonsymmetrical, corresponds to the opening (11) in the distal end of the base (10, 10*a*), is mounted in the cavity of the base (10, 10*a*) through the opening (11) in the distal end of the base (10, 10*a*) and has a cavity, an open top, a closed bottom, an inner surface and an LED lead seat (25, 25*a*). The open top is resilient, communicates with the cavity of the socket (20, 20*a*) and has a tapered inner edge. The closed bottom has two LED lead holes (24). The LED lead holes (24) are defined through the closed bottom. The inner surface is cylindrical and has an annular groove (21, 21*a*) and a positioning protrusion (23). The annular groove (21, 21*a*) is formed in the inner surface near the open top. The positioning protrusion (23) is formed on the annular groove (21, 21*a*) and has a flat surface. The LED lead seat (25, 25*a*) is a rectangular parallelepiped shape, is formed on and protrudes coaxially from the closed bottom and has four longitudinal surfaces and two seats (252, 252*a*). The seats (252, 252*a*) are formed respectively on two opposite longitudinal surfaces and correspond respectively to the LED lead holes (24), and each seat (252, 252*a*) faces the corresponding track (14) and has an inner surface. The inner surfaces of the seats (252, 252*a*) may be flat or have a longitudinal V-shaped, semicylindrical or rectangular groove.

The LED (30) is mounted in the socket (20, 20*a*) to emit light and has a bottom, a bottom flange and two leads (32). The bottom flange is formed around and protrudes radially from the bottom and has an outer edge and a positioning surface (31). The outer edge is mounted in the annular groove (21, 21*a*). The positioning surface (31) is flat, is formed on the outer edge of the bottom flange and corresponds to the flat surface of the positioning protrusion (23) to hold the LED (30) in the cavity of the socket (20, 20*a*) in a specific position. The leads (32) are mounted through and protrude longitudinally from the bottom, extend respectively through the LED lead holes (24), are mounted respectively against the inner surfaces of the seats (252, 252*a*) and have a positive lead and a negative lead. Each lead (32) has a latch hook (321). The latch hook (321) protrudes from the lead (32), extends through the LED lead hole (24) and abuts the closed bottom of the socket (20, 20*a*) around the LED lead hole (24) to prevent the LED (30) from disengaging from the socket (20, 20*a*). Because the leads (32) comprise a positive lead and a negative lead, the LED (30) has to be mounted in the correct orientation to ensure that the LED (30) emits light.

The connectors (40, 40*a*~40*f*) are mounted respectively on the seats (252, 252*a*) of the LED lead seat (25, 25*a*) in the cavity of the base (10, 10*a*) through the opening (12, 12*a*) and electrically connect respectively to the leads (32) protruding from the LED (30) in the cavity of the base (10, 10*a*), and each connector (40, 40*a*~40*f*) may be a crimp-type connector (40, 40*a*, 40*b*, 40*c*, 40*e*, 40*f*) or a blade-type connector (40*d*) and has an inner end, an outer end, a spade (41, 41*a*, 41*b*, 41*c*, 41*d*, 41*e*, 41*f*) and a wire fastener (42, 41*a*, 42*b*, 42*c*, 42*d*, 42*e*, 42*f*). The spade (41, 41*a*, 41*b*, 41*c*, 41*d*, 41*e*, 41*f*) is formed on the inner end of the connector (40, 40*a* ~40*f*), is mounted against a corresponding seat (252, 252*a*) of the LED lead seat (25, 25*a*) and respectively in the tracks (14), presses against the lead (32) from the LED (30) in the seat (252, 252*a*) to make electrical contact, corresponds to the seat (252, 252*a*) and may have a protruding contact (411, 411*a*, 411*b*, 411*c*, 411*e*, 411*f*). The protruding contact (411, 411*a*, 411*b*, 411*c*, 411*e*, 411*f*) is formed longitudinally on the spade (41, 41*a*, 41*b*, 41*c*, 41*e*, 41*f*) to form a space (412, 412*a*, 412*b*, 412*c*, 412*e*, 412*f*) may be a recess or a through hole, extends from the track (14) and presses against the lead (32) from the LED (30) in the seat (252).

In a first embodiment of the connector (40) in accordance with the present invention, the protruding contact (411) is punched from the spade (41), is L-shaped and extends toward the inner end of the connector (40).

In a second embodiment of the connector (40*a*) in accordance with the present invention, the protruding contact (411*a*) is punched from the spade (41*a*), is L-shaped and extends toward the outer end of the connector (40*a*).

In a third embodiment of the connector (40*b*) in accordance with the present invention, the protruding contact (411*b*) is punched from the spade (41*b*), is arced and extends longitudinally in the spade (41*b*) of the connector (40*b*).

In a fourth embodiment of the connector (40*c*) in accordance with the present invention, the protruding contact (411*c*) is punched longitudinally into the spade (41*c*), is a rectangular parallelepiped shape and communicates with the inner end of the connector (40*c*).

In a fifth embodiment of the connector (40*e*) in accordance with the present invention, the protruding contact (411*e*) is punched longitudinally into the spade (41*e*), is semicylindrical and communicates with the inner end of the connector (40*e*).

In a sixth embodiment of the connector (40*f*) in accordance with the present invention, the protruding contact (411*f*) is punched longitudinally into the spade (41*f*), is V-shaped and communicates with the inner end of the connector (40*f*).

Figure 11:
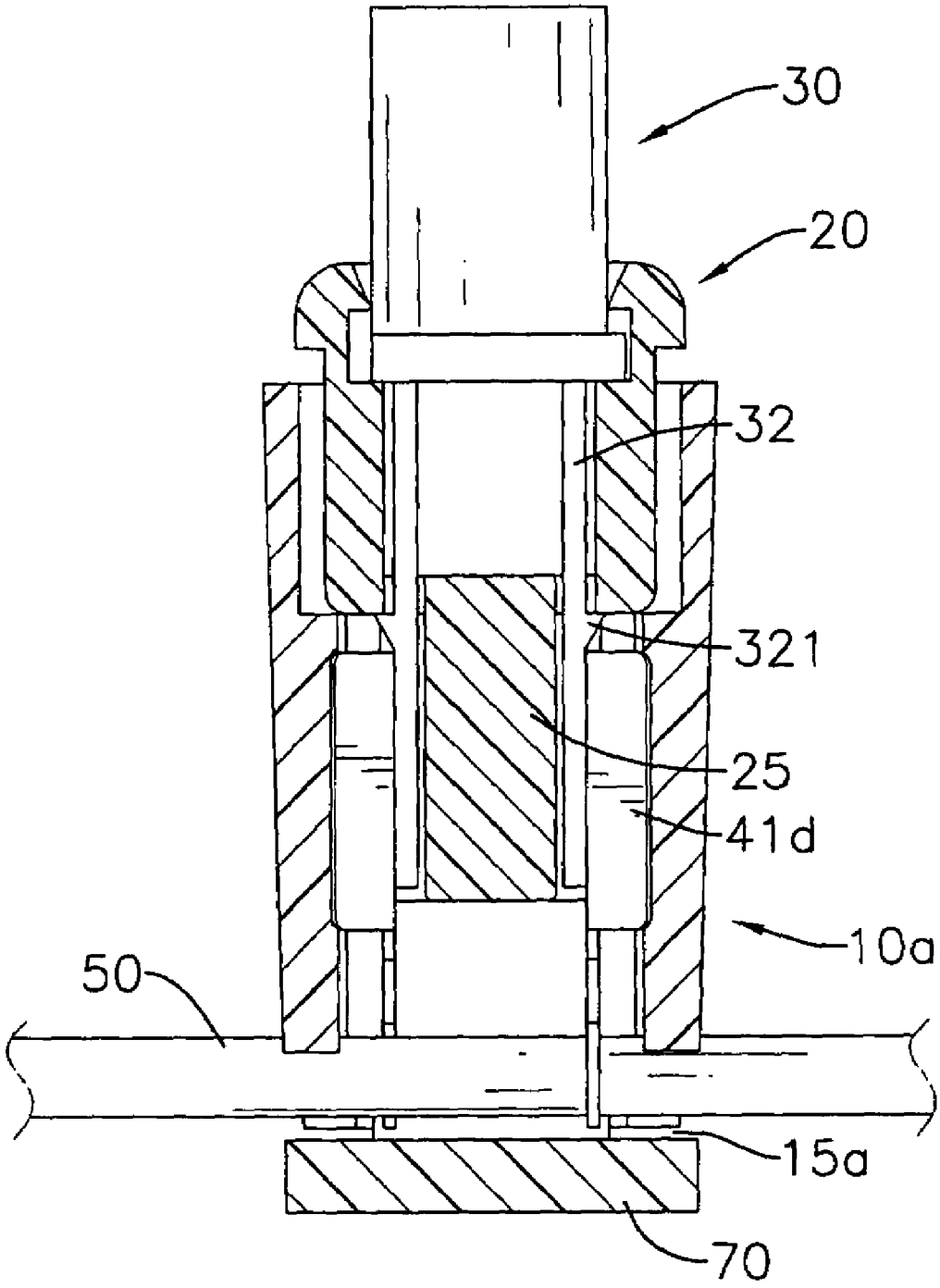
FIG. 11 is a front view in partial section of the decorative light in FIG. 9.
Figure 12:
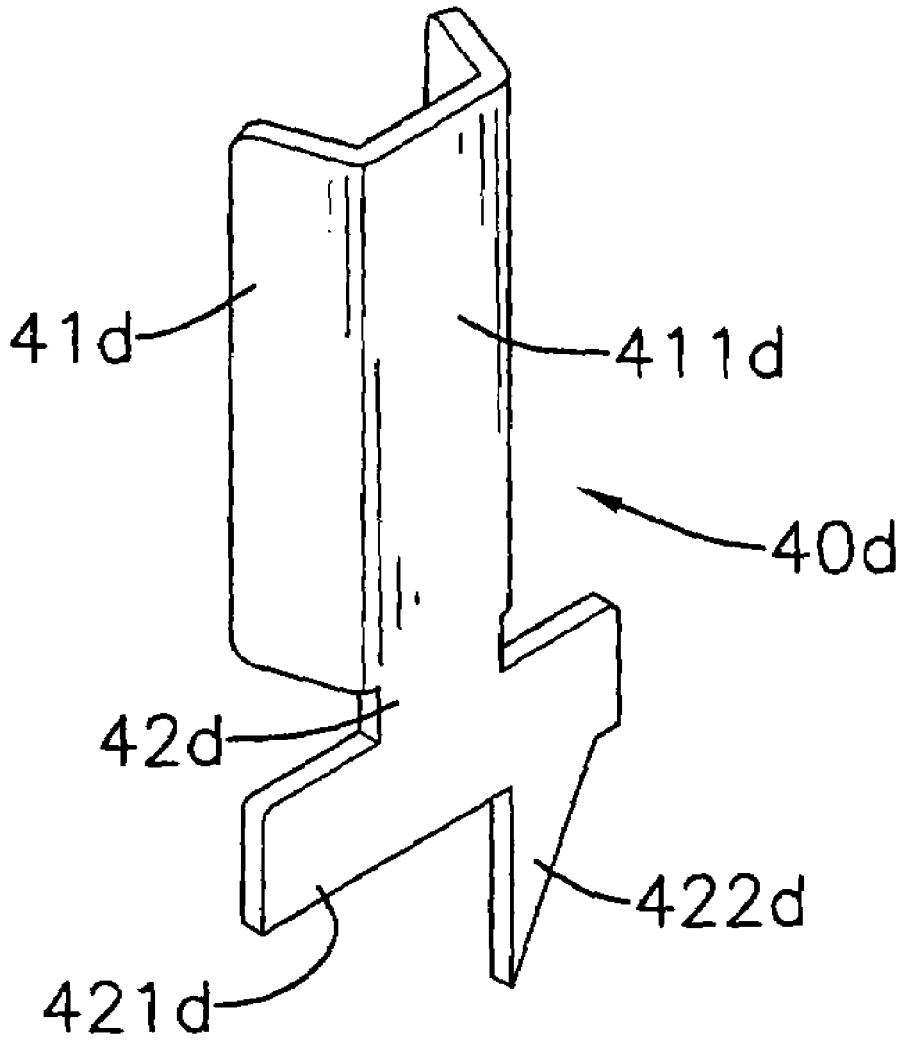
FIG. 12 is a perspective view of a connector of the decorative light in FIG. 10.
Figure 13:
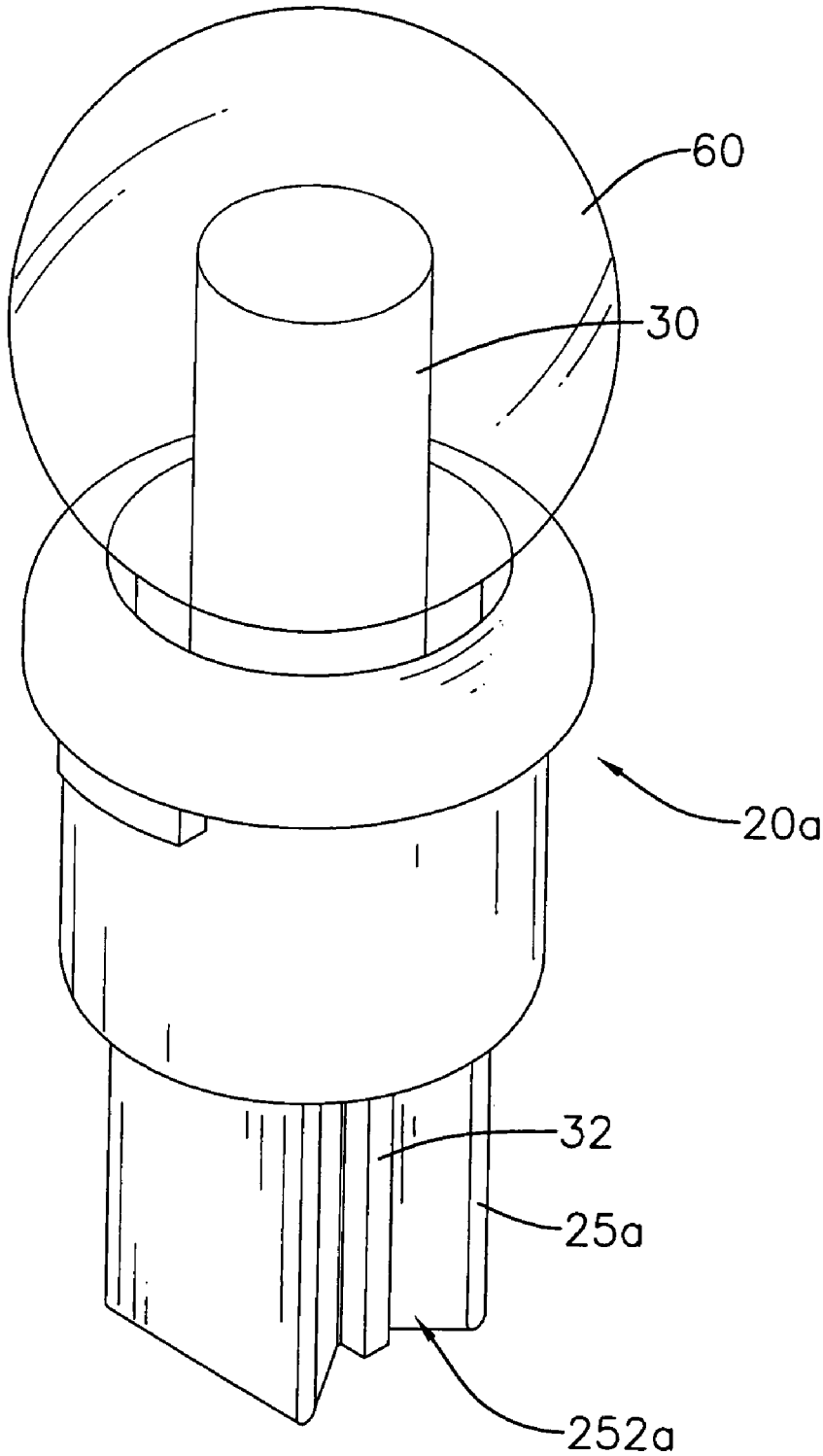
FIG. 13 is a perspective view of the decorative light in FIGS. 1 and 9 with a globe covering a light emitting diode.

With further reference to FIG. 11 and 12, each blade type connector (40*d*) has a contacting segment (41*d*) and a connecting segment (42*d*). The contacting segment (41*d*) has a radial cross section and an outer surface (411*d*). The radial cross section is U-shaped. The outer surface (411*d*) contacts electrically to the lead (32). The connecting segment (42*d*) is formed integrally with the contacting segment (41*d*) and has a rectangular sheet (421*d*). The sheet (421*d*) has an upper edge and a bottom edge. The upper edge of the sheet (421*d*) connects to the contacting segment (41*d*).

The wire fastener (42, 41*a*, 42*b*, 42*c*, 42*d*, 42*e*, 42*f*) is formed on the outer end of the connector (40, 40*a*~40*f*) and may be a clamp or a blade (422*d*).

The clamp is formed on the outer end of a crimp-type connector (40, 40*a*, 40*b*, 40*c*, 40*e*, 40*f*) and comprises a wire clamp (421) and an insulation clamp (422). The wire clamp (421) is malleable, is a split annular ring and is formed adjacent to the spade (41, 41*a*, 41*b*, 41*c*, 41*e*, 41*f*). The insulation clamp (422) is malleable, is a split annular ring, is slightly larger than the wire clamp (421) and is formed at the outer end of the connector (40, 40*a*, 40*b*, 40*c*, 40*e*, 40*f*).

The blade (422*d*) is formed on and protrudes longitudinally from the bottom edge of the sheet (421*d*) near one side such that when mounted in the seats (252*a*), the blades (422*d*) are on opposite sides.

The wires (50) extend into the cavity of the base (10, 10*a*), may extend through the through hole (12) in the base (10) or through the recesses (15*a*) in the base (10*a*), electrically connect respectively to the connectors (40, 40*a*~40*f*), selectively connect to a power source and provide electricity to the LEDs. Each wire (50) has a copper wire and an insulated cover and may have a proximal end. The copper wires are electrically connected respectively to the connectors (40, 40*a*~40*f*), and each copper wire may have a proximal end. In a first embodiment of the decorative light in accordance with the present invention, the proximal end of each copper wire protrudes from the proximal end of the wire (50) and is clamped by the corresponding wire clamp (421). In a second embodiment of the decorative light in accordance with the present invention, the copper wires are pierced respectively by the blades (422*d*) longitudinally extending respectively from the connectors (40*d*). The insulated covers are formed respectively around the copper wires, and each insulated cover may have a proximal end. The proximal end of each insulted cover is formed near the proximal end of the copper wire. In a first embodiment of the decorative light in accordance with the present invention, the proximal end of each insulated cover is clamped by the corresponding insulation clamp (422).

With further reference to FIG. 14, the globe (60) covers and protects the LED (30) and has a cover, a neck and an annular lip (61). The cover is hollow and may be spherical. The neck is formed on and protrudes from the cover, is mounted around the LED (30) and has a distal edge. The annular lip (61) is formed on and protrudes radially out from the distal edge of the neck, is mounted in the annular groove (21, 21*a*) in the socket (20, 20*a*) to attach the globe (60) to the socket (20, 20*a*) and presses against the bottom flange on the LED (30) to make the LED (30) steadier.

The latch hook (321) can stop the LED (30) from detaching from the socket (20, 20*a*) and the leads (32) connect electrically to the connector (40, 40*a*~40*f*), so the decorative light of the present invention is convenient to assemble and has a reduced production cost.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A decorative light comprising:

a base being hollow and having a cavity;

a distal end having an opening being defined through the distal end and communicating with the cavity;

a proximal end having a through hole being defined through the proximal end and communicating with the cavity;

an inner wall adjacent to the through hole at the proximal end; and a sidewall;

a socket being hollow, corresponding to the opening in the distal end of the base, being mounted in the cavity of the base through the opening and having a cavity;

an open top being resilient, communicating with the cavity of the socket and having a tapered inner edge;

a closed bottom having two LED lead holes being defined through the closed bottom;

an inner surface being cylindrical and having an annular groove formed in the inner surface near the open top; and an LED lead seat being a rectangular parallelepiped shape, being formed on protruding coaxially from the closed bottom and having four longitudinal surfaces; and two seats formed respectively on two opposite longitudinal surfaces and corresponding respectively to the LED lead holes, and each seat having an inner surface;

a light emitting diode (LED) being mounted the socket and having a bottom;

a bottom flange being formed around and protruding radially from the bottom and having an outer edge being mounted in the annular groove; and two leads being mounted through and protruding longitudinally from the bottom, extending respectively through the LED lead holes, being mounted respectively against the inner surfaces of the seats, and each lead having a latch hook protruding from the lead, extending through the LED lead hole and abutting the closed bottom of the socket around the LED lead hole;

two connectors being mounted respectively on the seats of the LED lead seat in the cavity of the base through the opening and electrically connecting respectively to the leads protruding from the LED in the cavity of the base, and each connector having an inner end;

an outer end;

a spade being formed on the inner end of the connector, being mounted against a corresponding seat of the LED lead seat, pressing against the lead from the LED in the seat to make electrical contact and corresponding to the seat; and a wire fastener being formed on the outer end of the connector; and two wires extending into the cavity of the base, electrically connecting respectively to the connectors and adapted for selectively connecting to a power source and providing electricity to the LEDs, and each wire having a copper wire connecting electrically to one of the connectors; and an insulated cover being formed around the copper wire.

2. The decorative light as claimed in claim 1, wherein the inner surface of each seat in the LED lead seat of the socket has a longitudinal rectangular groove.

3. The decorative light as claimed in claim 1, wherein the opening of the distal end of the base has a noncircular and nonsymmetrical shape; and the socket is noncircular and nonsymmetrical.

4. The decorative light as claimed in claim 1, wherein the inner surface of the socket further has a positioning protrusion formed on the annular groove and having a flat surface; and the bottom flange of the LED further has a positioning surface being flat, formed on the outer edge of the bottom flange and corresponding to the flat surface of the positioning protrusion to hold the LED in the cavity of the socket in a specific position.

5. The decorative light as claimed in claim 1 further having a globe covering and protecting the LED and having a cover being hollow;

a neck being formed on and protruding from the cover, being mounted around the LED and having a distal edge; and an annular lip being formed on and protruding radially out from the distal edge of the neck, being mounted in the annular groove in the socket to fasten the globe and pressing against the bottom flange of the LED.

6. The decorative light as claimed in claim 1, wherein the sidewall adjacent to the proximal end of the base further has two recesses formed in the sidewall opposite to each other and communicating with the cavity and the through hole in the proximal end of the base; and the base further has a cap mounted in and closing the through hole at the proximal end of the base;

the wire fastener is a blade formed on and protruding longitudinally from the outer end of the connector near one side;

the wires extend through the recesses in the base; and the copper wires are pierced respectively by the blades longitudinally extending respectively from the connectors.

7. The decorative light as claimed in claim 1, wherein each connector is a crimp-type connector;

the wire fastener of each crimp-type connector is a clamp, is formed on the outer end of the crimp-type connector and comprises a wire clamp being malleable, being a split annular ring and formed adjacent to the cavity of the base;

the wires extend through the through hole in the base and further has a proximal end; and the copper wire of each wire has a proximal end protruding from the proximal end of the wire and being clamped by a corresponding wire clamp.

8. The decorative light as claimed in claim 5, wherein the globe is spherical.

9. The decorative light as claimed in claim 7, wherein the inner wall of the base adjacent to the through hole has two tracks formed opposite to each other and communicating with the through hole at the proximal end of the base, and each track has two sides and two rails formed on and protruding from the inner wall toward each other; and each seat of the LED lead seat of the socket facing a corresponding track; and the spades of the connectors are mounted respectively in the tracks.

10. The decorative light as claimed in claim 7, wherein the clamp of each crimp-type connector further comprises an insulation clamp being malleable, being a split annular ring, being slightly larger than the wire clamp and being formed at the outer end of the crimp-type connector; and the insulation cover of each wire has a proximal end formed near the proximal end of the copper wire of the wire and is clamped by a corresponding insulation clamp.

11. The decorative light as claimed in claim 9, wherein the spade of each connector has a protruding contact formed longitudinally on the spade, extending from the track and pressing against the lead from the LED in one of the seats.

12. The decorative light as claimed in claim 10, wherein the protruding contact of each connector is punched from the spade of the connector, is L-shaped and extends toward the inner end of the connector.

13. The decorative light as claimed in claim 10, wherein the protruding contact of each connector is punched from the spade of the connector, is U-shaped and extends toward the outer end of the connector.

14. The decorative light as claimed in claim 10, wherein the protruding contact of each connector is punched from the spade of the connector, is arced and extends longitudinally in the spade of the connector.

15. The decorative light as claimed in claim 10, wherein the protruding contact of each connector is punched longitudinally into the spade of the connector, is a rectangular parallelepiped shape and communicates with the inner end of the connector.

16. The decorative light as claimed in claim 10, wherein the protruding contact of each connector is punched longitudinally into the spade of the connector, is semicylindrical and communicates with the inner end of the connector.

17. The decorative light as claimed in claim 10, wherein the protruding contact of each connector is punched longitudinally into the spade of the connector, is V-shaped and communicates with the inner end of the connector.

* * * * *